United States Patent [19]

Cannell

[11] 4,214,964

[45] Jul. 29, 1980

[54] ELECTROLYTIC PROCESS AND APPARATUS FOR THE RECOVERY OF METAL VALUES

[76] Inventor: John F. Cannell, 55, Boddington Rd., Byfield, Daventry, Northamptonshire, England

[21] Appl. No.: 19,618

[22] Filed: Mar. 12, 1979

[30] Foreign Application Priority Data

Mar. 15, 1978 [GB] United Kingdom ..... 10250978

[51] Int. Cl.[2] ..... C25C 1/100

[52] U.S. Cl. ..... 204/105 R; 204/261; 204/265; 204/295

[58] Field of Search ..... 204/105 R, 106, 107, 204/112, 120, 114, 252, 284, 261, 265, 295, 264

[56] References Cited

U.S. PATENT DOCUMENTS

| | | | |
|---|---|---|---|
| 1,052,256 | 2/1913 | Hybinette | 204/295 |
| 1,115,351 | 10/1914 | Wagner | 204/107 |
| 2,045,212 | 6/1936 | Bosqui | 204/112 |
| 2,595,387 | 5/1952 | Kalling et al. | 204/112 |
| 4,064,022 | 12/1977 | Kawasaki et al. | 204/105 R |
| 4,107,006 | 8/1978 | Winand | 204/105 M |

*Primary Examiner*—John H. Mack
*Assistant Examiner*—D. R. Valentine
*Attorney, Agent, or Firm*—Schuyler, Birch, McKie & Beckett

[57] ABSTRACT

An electrolytic process and an electrolytic cell for recovering metal values from low grade concentrates. The said concentrate is introduced into the cell containing an aqueous electrolyte so that it is retained in proximity to an anode or anodes and kept out of contact from the or each cathode. The cell is energized so that electrolysis takes place and acid is released at the anode(s) which dissolves the metal values which form cations which migrate to and are discharged at the cathode(s). The impurities in the concentrate form fine particles which are separated from the concentrate by screening, e.g. by means of a grid or grids separating the anodes from the cathodes.

9 Claims, 1 Drawing Figure

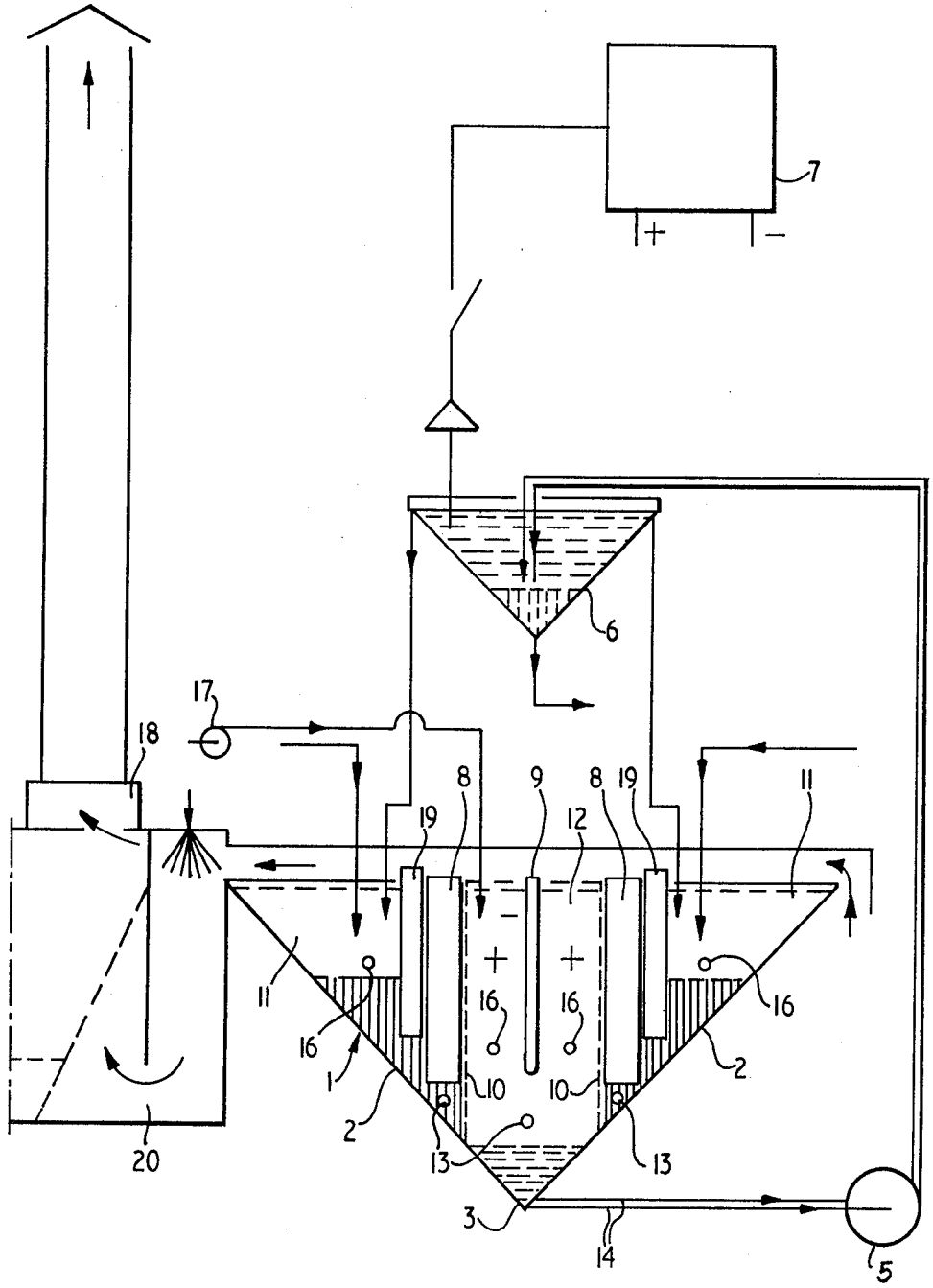
7
+
−
6
17
18
8
9
8
19
11
19
12
11
16
16
16
16
1
2
2
10
10
13
13
20
3
14
5

ELECTROLYTIC PROCESS AND APPARATUS FOR THE RECOVERY OF METAL VALUES

The present invention relates to a process and also to an electrolytic cell for electrolytically recovering metal values from a solid concentrate.

The metal finishing industry produces liquid effluents containing nickel, cobalt, zinc, copper and iron cations which are conventionally precipitated as hydroxides or carbonates which are converted to low value filter cake which up to now has been discarded. This filter cake typically contains, in the case of nickel effluent, 7 to 12% of nickel by weight, the remainder consisting mainly of ferric hydroxide, water and foreign bodies.

The metal treatment industry also produce other solid wastes such as cobalt and nickel-containing sludges from the machining and grinding of castings and the drawing of wire.

It is theoretically possible to recover the metal values from these filter cakes or sludges by dissolving in an appropriate acid and then subjecting the resultant concentrated metal-containing solution to electrolysis, as is currently practised in electro-winning. However, as the electrolysis progresses the concentration of cations falls and the acidity of the solution rises so that the efficiency of the process decreases until after a relatively short time metal deposition stops and although electrolysis continues, only oxygen and hydrogen are produced.

Although it is possible to overcome these problems by the removal of the highly acid electrolyte from the cell, dissolving therein further metal-containing residues, evaporating off excess water, and removing insoluble impurities by filtration, such a process is costly and complicated in that it involves bulky and expensive chemical plant (e.g. reaction vessels, filters, stirrers and evaporators), thus rendering the process uneconomic.

We have now developed a process and an electrolytic cell which enable metals such as nickel to be recovered from, for example, hydroxide-containing wastes without recourse to such bulky and expensive plant.

According to one aspect of this invention we provide a process for electrolytically recovering metal values from a solid concentrate, characterised in that the concentrate is introduced into an electrolytic cell containing an aqueous electrolyte so that the concentrate is retained in proximity to the or each anode and kept out of contact with the or each cathode, and energising the cell so that electrolysis takes place and acid is released at the or each anode, which acid dissolves the said metal values to form cations which are discharged at the or each cathode, and insoluble impurities in the concentrate are released at the or each anode as fine particles which are separated by screening from the unreacted concentrate and accumulate in the bottom of the cell.

The concentrate can be in any form (e.g. course particulate, lump, aggregate, or paste), provided that it can be separated from the insoluble impurities by screening. If the concentrate is not already in a suitable form it can be converted to pellets or briquettes before being subjected to the process.

The metal to be recovered must be a metal which will electroplate from solution and must be such that plating conditions in the cell can be maintained by dissolving metal from a solid concentrate maintained in the vicinity of the anode(s) below solution level, e.g. by gravity or by an indexing pusher mechanism.

Examples of suitable metals are Ni, Cu, Co, Sn and Zn.

Examples of suitable electrolytes are sulphuric, hydrochloric and sulphamic acids; solutions of ammonia and its salts and derivitives (e.g. ammines and amines).

The electrolysis is preferably started by utilising an electrolyte containing cations of the metal to be recovered. It is not normally necessary to add further electrolyte solution.

The insoluble impurities released at the anode(s) are separated from the concentrate by screening through a grid, mesh or woven fabric, dependant on particle size, and suspended between the anode(s) and cathode(s). Alternatively the or each anode itself may be in the form of a grid, mesh or woven fabric.

In either case the size of the apertures in the grid is so chosen that the concentrate is retained until it has been almost totally reacted but so that the resulting fine particles of insoluble impurity can pass through without clogging.

In one case the concentrate is the above mentioned-nickel hydroxide from the nickel plating industry, in the form of a filter cake. The nickel values are recovered by the process of the invention and ferric oxide constitutes the finely-divided insoluble particles of impurity.

In this case the following main electrochemical reactions are thought to take place within the cell.

Anode (Insoluble)

$$2\,H_2O \longrightarrow 4H^+ + O_2 + 4_e$$

$$Ni(OH)_2 + 2H^+ \longrightarrow Ni^{2+} + 2H_2O$$

Cathode $$Ni^2 + 2e^- \longrightarrow Ni.$$

Thus, at the anode, $H^+$ ions are produced which immediately react with solid $Ni(OH)_2$ resulting in the formation of $Ni^{2+}$ cations, which migrate towards, and are deposited on, the cathode. Water is released at the anode. The process is preferably carried out under such conditions (e.g. electrolyte temperature; heat input; swept air velocity across the surface of the electrolyte and rate of air agitation) that water evaporates from the electrolyte at substantially the same rate as it is introduced by addition of the concentrate. Thus the electrolyte does not become increasingly dilute as the recovery process proceeds.

The temperature and heat input may be controlled by regulating the resistance of the cell by varying the anode to cathode distance or by installing immersion heaters or heat exchangers. As the acid ($H^+$ ions) released at the anode immediately react with further concentrate the acidity of the electrolyte does not rise and the concentration of ions of the metal to be recovered is maintained at a sufficiently high level.

The concentrate in the vicinity of the anode(s) is preferably agitated periodically or continuously, especially by the introduction of high pressure air, to ensure that the acid released comes into contact with fresh concentrate. However, mechanical agitation, or agitation by pumped circulation of the electrolyte, is also possible. Also, if necessary to ensure adequate circulation of electrolyte within both anode and cathode compartments, e.g. to prevent stratification and local overheating effects, a continuous stream of low pressure air may be introduced at points throughout the body of electrolyte. This air also serves to improve the rate of water evaporation.

In these ways the disadvantages mentioned above, i.e. a gradual decrease in concentration of the metal values to be recovered, a gradual increase in acidity and a volumetric increase of electrolyte due to the introduction of water to the system, are avoided.

The current densities which may be employed may, for example, be within the range 1 to 10 $A/dm^2$ and more preferably within the range 1 to 5 $A/dm^2$ in order to build up a massive cathode deposit with minimal internal stress. In particular 3 $A/dm^2$ of cathode has been found to be suitable for plating nickel from a sulphate solution.

According to another aspect of this invention we provide an electrolytic cell for recovering metal values from a solid concentrate so that the metal values are deposited on the or each cathode and insoluble impurities in the concentrate form fine particles, characterised in that the cell incorporates at least one grid having apertures too small to allow passage of the concentrate for isolating the concentrate from the or each cathode, but large enough to permit passage of the impurities so that they may accumulate in the bottom of the cell.

The grid or grids may form the anode or anodes in which case they are formed from a conducting material not significantly eroded during the electrolytic process, e.g. platinum-plated titanium, lead or graphite.

Preferably, though, a separate grid is used. This may be of any suitable insoluble material such as perforated polypropylene sheet, woven polypropylene filter cloth, "Terylene" or other polyester net or plastics coated metal mesh. In this case the anodes are preferably conventional "insoluble anodes", e.g. of platinum-coated titanium, lead or graphite depending upon the nature of the electrolyte.

The grid or grids divide the interior of the cell into one or more anode and cathode compartments.

Provision for periodically or continuously agitating the concentrate mass by means of injection of pressurised air is preferably provided, and also means for ensuring continuous electrolyte circulation within the anode and cathode compartments, e.g. inlets for low pressure air or mechanical stirrers. A pH probe, located in an external circulating loop, may be arranged to actuate a high pressure air blower for agitating the concentrate when the pH falls below a pre-set value. Alternatively, such a blower may be actuated on a time basis by a cam controller. The pH of the electrolyte is preferably regulated to maintain an optimum value in the anode compartments, e.g. within the range of 0 to 10, and 1.0 to 10 in the cathode compartment, depending on the metal to be recovered and the electrolyte used.

In construction the cell is preferably tapering, e.g. triangular in cross-section, and may for example be constructed from ebonite-lined mild steel plate. It may have two lateral rows of anodes with a central low of cathodes, each row of anodes being separated from the cathodes by a substantially vertical grid. Thus, it has a central cathode compartment and two lateral anode compartments.

In use the cell is initially filled with electrolyte and a quantity of concentrate placed in each of the two anode compartments so that it contacts the anodes and is retained by the grids. Electrolysis is started and hydrogen ions are released which cause the metal values to dissolve and the resulting cations then migrate to the cathodes.

Preferably, the starting electrolyte contains cations of the metal to be deposited. If not, no deposition of the metal to be recovered takes place until the concentration of those metal cations in the electrolyte has reached the minimum level for plating.

The fine impurities released in the anode compartments pass through the grid or grids and sink to the bottom of the cell for removal, e.g. by a sludge pump which may deliver to a settlement cone, from which the supernatant electrolyte is returned by gravity to the cell in the vicinity of the anode or anodes.

One cell embodying the invention for recovering nickel values is shown by way of example in the accompanying schematic diagram.

This cell comprises an elongated hollow tapering cell body 1 which serves as a container for the electrolyte having two lateral sides 2 which converge towards the bottom 3. Two outlets 4 are provided in the bottom connecting to a sludge transfer pump 5 which in turn delivers to a settlement cone 6 of known type.

Above the container are supported three spaced and parallel bus bars which are connected to a rectified source of electrical energy 7 in such a way that the central bar is negatively charged and the lateral bus bars are each positively charged.

From each lateral bar is suspended a row of graphite anodes 8 and from the central bus bar is suspended a row of etched nickel cathodes 9.

Between each row of anodes and the central row of cathodes is interposed a vertical grid 10 constructed from 10 mm thick injection moulded perforated polypropylene panels. The perforations are square in section and taper from 4 mm diagonal on the anode side to 8 mm diagonal on the cathode side. The grids extend vertically to meet the sides of the container near the bottom and the grids divide the container into two lateral anode comparments 11 and one central cathode compartment 12. In each of the compartments 11 and in the compartment 12 is located a high pressure air agitation manifold 13 supplied periodically by compressed air from a blower actuated by a cam controller (not shown). Compartments 11 and 12 are also provided with low pressure air agitation pipes 16 for continuous electrolyte circulation. Provision is made for periodically dosing the central compartment with a flocculating agent by metering pump 17. An extraction fan 18 causes air to be drawn across the surface of the electrolyte in container 1 to remove the water vapour generated by the hot electrolyte which is maintained at a temperature of 40°–60° C. by means of immersion heaters 19 and the heating effect of the current passing between anodes and cathodes. Before venting to atmosphere the extracted air passes through a fume scrubber 20.

The invention is further illustrated by the following non-limiting example:

The cell is first partly filled with an electrolyte containing $NiSO_4$, $H_3BO_3$ and the pH adjusted to a value of 4.0. Compartments 11 are half filled with nickel-containing concentrate in the form of nickel hydroxide filter cake and freshly etched nickel cathode starter plates are suspended from the central anode bar. The temperature of the electrolyte is increased to 25° C. by means of the immersion heaters and electrolysis is started.

The concentrate, which takes the form of a clay-like solid containing 7 to 13% nickel by weight, is retained in compartments 11 by the vertical grids 10. Due to the converging configuration of the side walls 2 it is held, by gravity, in contact with anodes 8 thus becoming anodic itself and dissolving continually in the electrolyte, the nickel being deposited on the cathodes for subsequent recovery.

$Fe(OH)_3$, which is present as an impurity in the nickel concentrate, passes through the apertures in the grids and settles out at the bottom of the cell for periodic removal by the transfer pump 5.

The passage of the insoluble impurities through the vertical grids is assisted by the hydraulic gradient existing between the compartments 11 and 12 brought about by the periodic operation of transfer pump 5.

What is claimed is:

1. A process for electrolytically recovering metal values from a solid concentrate which remains in the form of coarse particles or lumps when added to a liquid, characterised in that the concentrate is introduced into an electrolytic cell containing an aqueous electrolyte so that the concentrate is retained in proximity to the or each anode and kept out of contact with the or each cathode, and energising the cell so that electrolysis takes place and acid is released at the or each anode, which acid dissolves the said metal values to form cations which are discharged at the or each cathode, and insoluble impurities in the concentrate are released at the or each anode as fine particles which are separated by screening from the unreacted concentrate and accumulate in the bottom of the cell, and in that further concentrate is periodically or continuously added to the cell in the vicinity of the or each anode, the solid impurities are periodically and continuously removed from the cell bottom, and the water produced in the electrolytic reaction is removed by evaporation.

2. A process according to claim 1, characterised in that the concentrate in the cell is periodically or continuously agitated.

3. A process according to claim 2, characterised in that the agitation is effected by introduction into the cell of air under pressure.

4. An electrolytic cell for recovering metal values from a solid concentrate so that the metal values are deposited on at least one cathode and the insoluble impurities in the concentrate form insoluble fine particles, characterised in that the cell incorporates at least one grid so arranged within the cell that insoluble impurities and the unreacted concentrate come into contact with it, the grid having apertures too small to allow passage of the unreacted concentrate, for isolating the concentrate from the or each cathode, but large enough to permit passage of the impurities so that they may accumulate in the bottom of the cell, and means for withdrawing accumulated concentrate from the cell bottom.

5. An electrolytic cell according to claim 4, characterised in that the or each grid forms an anode and is of a conductive material resistant to erosion under the conditions prevailing during electrolysis.

6. An electrolytic cell according to claim 4, characterised in that the or each grid is located between at least one anode and at least one cathode.

7. An electrolytic cell according to any of claims 4 to 6, characterised in that it tapers towards the cell bottom.

8. An electrolytic cell according to any of claims 4 to 6, characterised in that it incorporates means for injecting pressurised air into the cell in the vicinity of the anode or anodes for agitating the concentrate.

9. An electrolytic cell according to claim 4, characterised in that it includes an elongated cell body which tapers towards the bottom and is triangular in cross-section, a central row of vertical cathodes within the body and parallel to the longitudinal axis thereof, two rows of vertical anodes within the body parallel to the row of cathodes, and disposed in either side thereof, each row of cathodes being separated from the rows of anodes by a vertical grid extending downwards from the top of the cell to meet the converging lateral walls of the cell body near the cell bottom, which grids divide the cell into a central cathode compartment and two lateral anode compartments, inlets being provided in the inlet walls of the cell body for introducing pressurised air into the anode compartments.

* * * * *